US007341477B2

(12) United States Patent
Kato

(10) Patent No.: US 7,341,477 B2
(45) Date of Patent: Mar. 11, 2008

(54) CONNECTOR FOR FLEXIBLE SUBSTRATE

(75) Inventor: Ryuhei Kato, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 11/724,175

(22) Filed: Mar. 15, 2007

(65) Prior Publication Data

US 2007/0218713 A1 Sep. 20, 2007

(30) Foreign Application Priority Data

Mar. 17, 2006 (JP) ..... 2006-073719

(51) Int. Cl.
*H01R 12/24* (2006.01)

(52) U.S. Cl. ..... 439/495; 439/260

(58) Field of Classification Search ..... 439/260, 439/267, 495

See application file for complete search history.

(56) References Cited

U.S. PATENT DOCUMENTS 5,240,430 A * 8/1993 Soes ..... 439/260
6,837,740 B2 * 1/2005 Kunishi et al. ..... 439/495
7,052,300 B2 * 5/2006 Okita et al. ..... 439/260
7,112,079 B2 * 9/2006 Miura et al. ..... 439/260
7,137,838 B2 * 11/2006 Koga ..... 439/260
7,140,896 B2 * 11/2006 Takai et al. ..... 439/260
2005/0255732 A1 11/2005 Sunaga ..... 439/260

FOREIGN PATENT DOCUMENTS

EP 1 148 590 10/2001
JP 2002-93504 3/2002
JP 2002-134194 5/2002

* cited by examiner

*Primary Examiner*—Thanh-Tam Le
(74) *Attorney, Agent, or Firm*—Kratz, Quintos & Hanson, LLP

(57) ABSTRACT

A connector for a flexible substrate of the present invention includes a housing having a board insertion port for receiving a flexible substrate, contacts of first and second types provided in parallel with each other inside the housing and supported pivotally and rotatably on an upper side of the housing and provided with cam portions, the cam portions being adapted to directly or indirectly press the contacts for bringing the contacts into pressure contact with the electrodes of the flexible substrate when the actuator is rotated to be put into a closed state. The contacts of the first and second types each has a base portion attachable to a back portion of the board insertion port of the housing, and an arm portion having a substantially U-shaped side view, being supported in midair by the base portion and being adapted to support an end portion of the flexible substrate.

7 Claims, 5 Drawing Sheets

(a)

(b)

(a)

(b)

CONNECTOR FOR FLEXIBLE SUBSTRATE

The present application claims priority under 35 U.S.C. §119 of Japanese Patent Application No. 2006-073719 filed on Mar. 17, 2006, the disclosure of which is expressly incorporated by reference herein in its entity.

BACKGROUND OF THE INVENTION

1. Field of the Invention

The present invention relates to a connector for a flexible substrate that is connected to an end portion of a flexible substrate.

2. Description of the Related Art

As this type of connector for a flexible substrate, there is exemplified a connector including a housing formed with a board insertion port for receiving a flexible substrate, contacts provided in parallel with each other so as to be contactable with electrodes of the flexible substrate inside the housing, and an actuator supported pivotally and rotatably on the upper side of the housing.

The contacts in this case are elastic plate-like pieces having E-shaped side views, the lower slit of which is adapted to receive an end portion of the flexible. In this state, when an actuator is rotated into a closed state, cam portions installed in the actuator press down contact piece portions at the centers of the contacts to bring them into pressure contact with electrodes of the flexible substrate (for example, Japanese Patent Application Laid-Open No. 2002-93504).

SUMMARY OF THE INVENTION

However, in the above-described conventional example, when the contacts are made shorter in length, they tend to fail to provide a predetermined contact pressure and contacts easily lose resilience, which would hinder the downsizing of the whole connector. However, if a highly elastic material is used for the contacts, this poses another problem of high cost.

The present invention is devised under the above-described background, and an object of the present invention is to provide a connector for a flexible substrate in which a desired contact pressure is obtained without causing increases in size and cost.

A connector for a flexible substrate according to the present invention is provided with a housing having a board insertion port for receiving a flexible substrate; contacts provided in parallel with each other so as to be contactable with electrodes of the flexible substrate inside of the housing; and an actuator supported pivotally and rotatably on an upper side of the housing and provided with cam portions, the cam portions being adapted to directly or indirectly press the contacts for bringing the contacts into pressure contact with the electrodes of the flexible substrate when the actuator is rotated to be put into a closed state, each of the contacts having a base portion attachable to a back portion of the board insertion port of the housing; an arm portion having a substantially U-shaped side view, being supported in midair by the base portion and being adapted to support an end portion of the flexible substrate; and a contact point portion being arranged inside the arm portion and adapted to contact with the electrode of the flexible substrate.

In a connector for a flexible substrate in accordance with an aspect of the present invention, when the end portion is inserted into the board insertion port of the housing, it is received by the arm portions of the contacts, and when the actuator is rotated to thereby press the cam portions against the arm portions of the contacts, the contact point portions of the contacts are brought into pressure contact with the electrodes on the surface of the flexible substrate. At this time, because the entire arm portions are elastically deformed to support the end portion of the flexible substrate, a large contact pressure can be obtained. Consequently, a predetermined contact pressure can be maintained without employing long contacts or highly elastic, and the invention brings about a significant advantage in the downsizing and cost reduction of the whole connector.

In a connector for a flexible substrate in accordance with an aspect of the present invention, since cam portions of first type of the actuator may contact with the upper sides of tip portions of upper linear portions of the arm portions of the contacts, and the contact points of the contacts are arranged in positions on the board-insertion-direction side as compared with the cam portions of the first type, the entire arm portions of the contacts significantly contract in accordance with the rotation of the actuator, and a large force acts on the contact point portions of the contacts, resulting in larger contact pressure.

In a connector for a flexible substrate in accordance with an aspect of the present invention, since lower linear portions of the arm portions of the contacts are longer than the upper linear portions, and cam portions of second type of the actuator make contact through the flexible substrate with tip portions of the lower linear portions of the arm portions of the contacts, the entire arm portions of the contacts significantly contract in accordance with the rotation of the actuator, and a large force acts on the contact point portions of the contacts, resulting in large contact pressure.

In a connector for a flexible substrate in accordance with an aspect of the present invention, since contacts have rotary shaft holding portions for holding rotary shafts of the actuator, the invention may totally or partly dispense with parts for preventing the pull-out of the actuator and for pivotally supporting the same, which simplifies the construction of the connector resulting in reduced cost.

In a connector for a flexible substrate in accordance with an aspect of the present invention, since elastic supporting portions of contacts of the second type are bend into ¼ circular arcs, the end portion of the flexible substrate is slightly lifted upward, and in accordance with this, the contact point portions of contacts of the second type become closer to the electrode in an outer row of the flexible substrate, so that large contact pressure can be obtained also for the contacts of the second type as in the contacts of the first type.

In a connector for a flexible substrate in accordance with an aspect of the present invention, even when end portions of the contacts on the board-insertion-direction side are exposed from a side of the housing opposite to the board insertion port, the side of the housing is covered with a dustproof cover portion when the actuator is in a closed state. Therefore, the invention brings about a high dustproof effect and high performance.

DESCRIPTION OF THE PREFERRED EMBODIMENT

Hereinafter, an embodiment of a connector for a flexible substrate according to the present invention is described with reference to the drawings.

Figure 1:
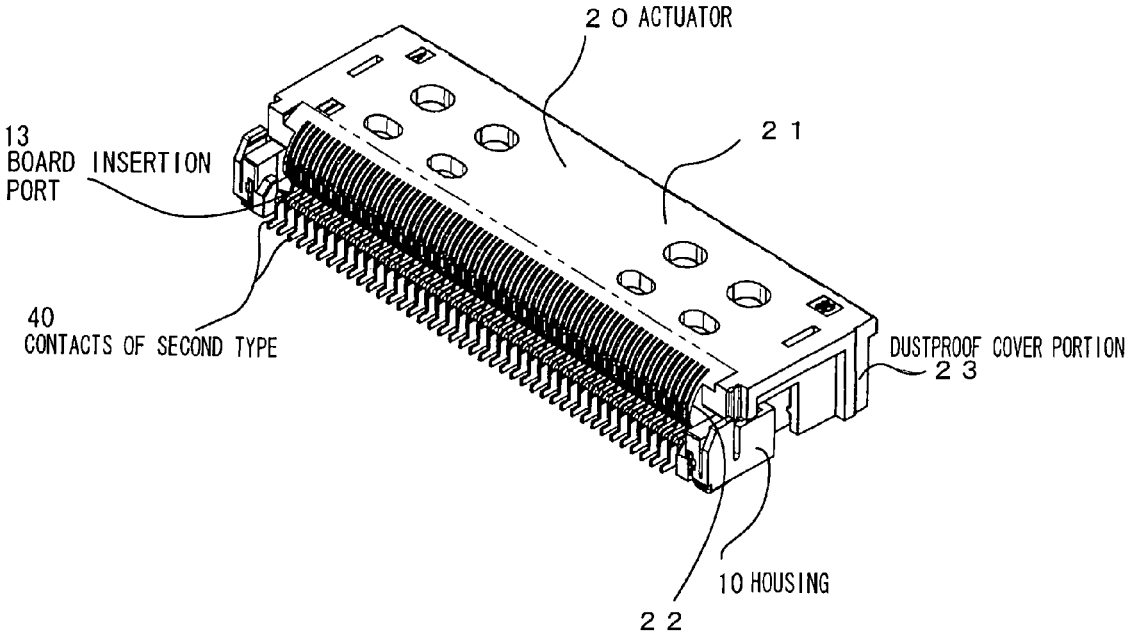
FIG. 1 is a perspective view for explaining an embodiment of the present invention, showing a closed state of a connector for a flexible substrate.
Figure 2:
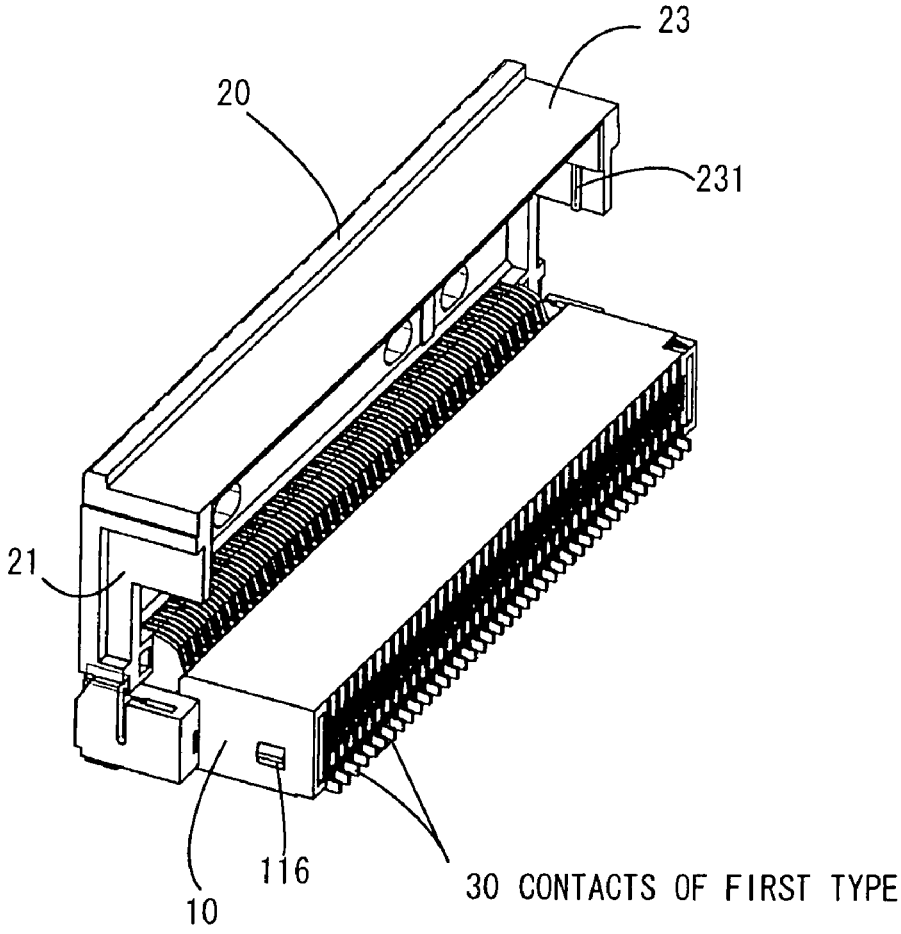
FIG. 2 is a perspective view showing an opened state of the same connector for a flexible substrate.
Figure 3:
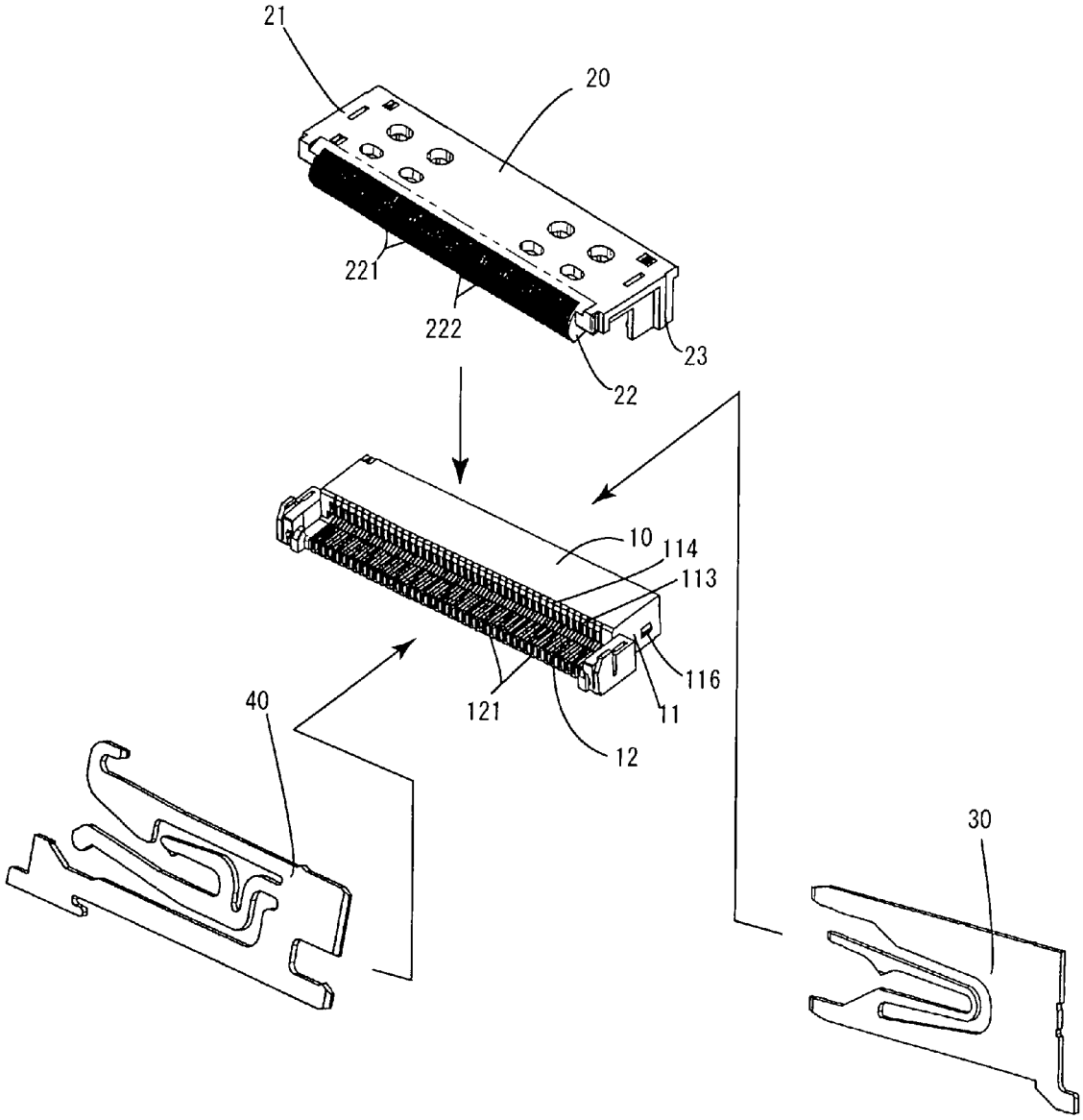
FIG. 3 is an exploded perspective view of the same connector for a flexible substrate.
Figure 4:
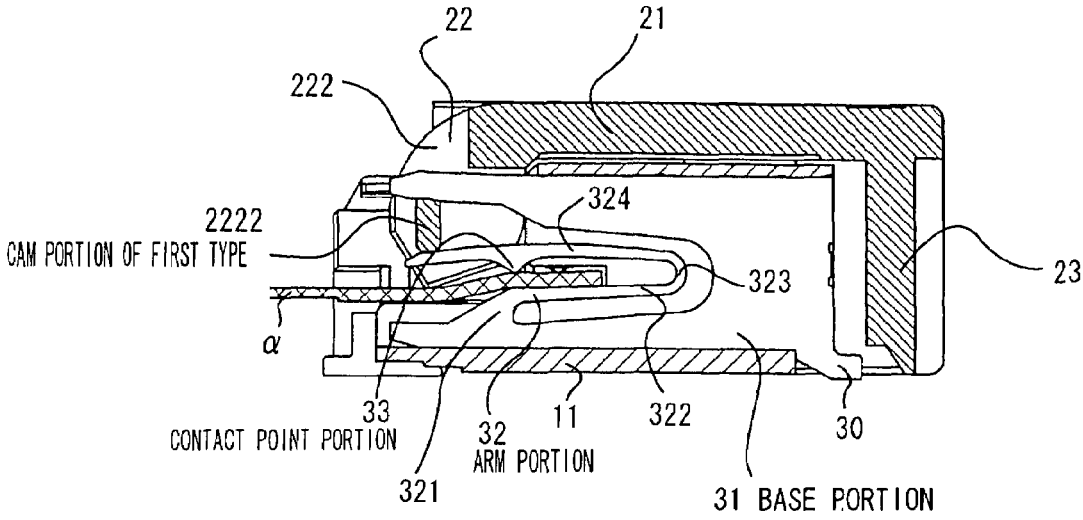
FIGS. 4(*a*) and 4(*b*) are cross-sectional views showing a shape of a first contact of the same connector for a flexible substrate.
Figure 4:
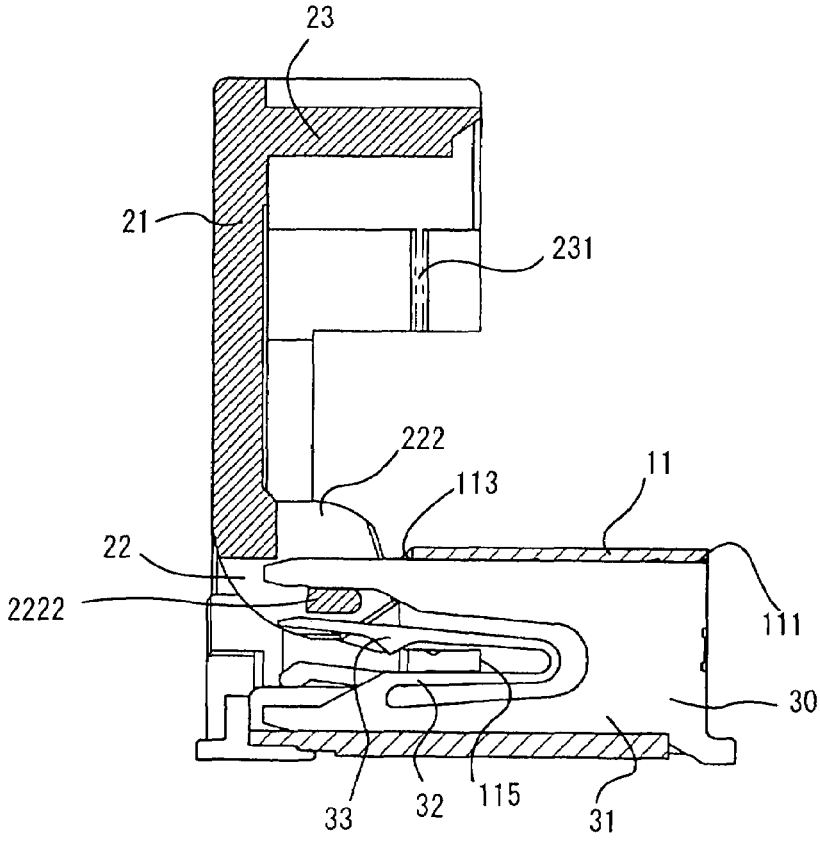
Figure 5:
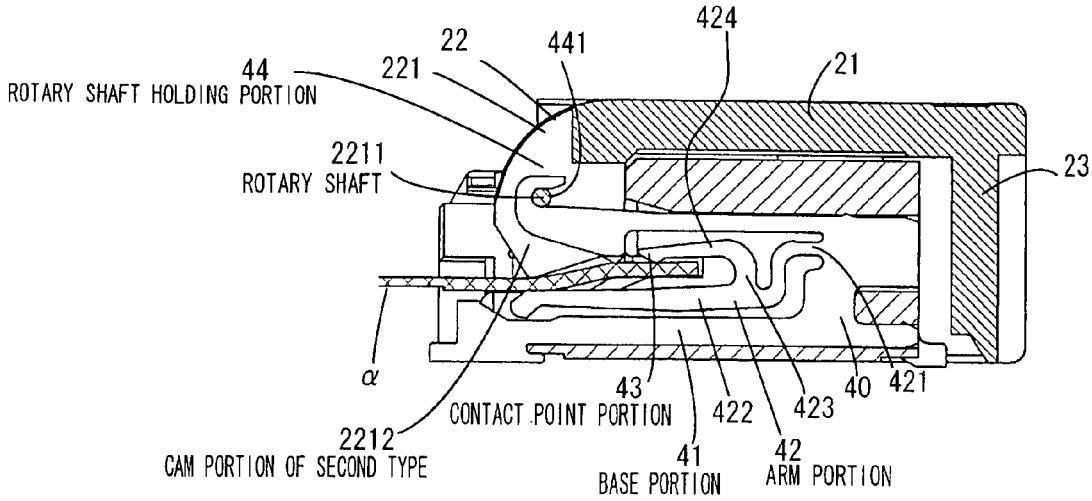
FIGS. 5(*a*) and 4(*b*) are cross-sectional views showing a shape of a second contact of the same connector for a flexible substrate.
Figure 5:
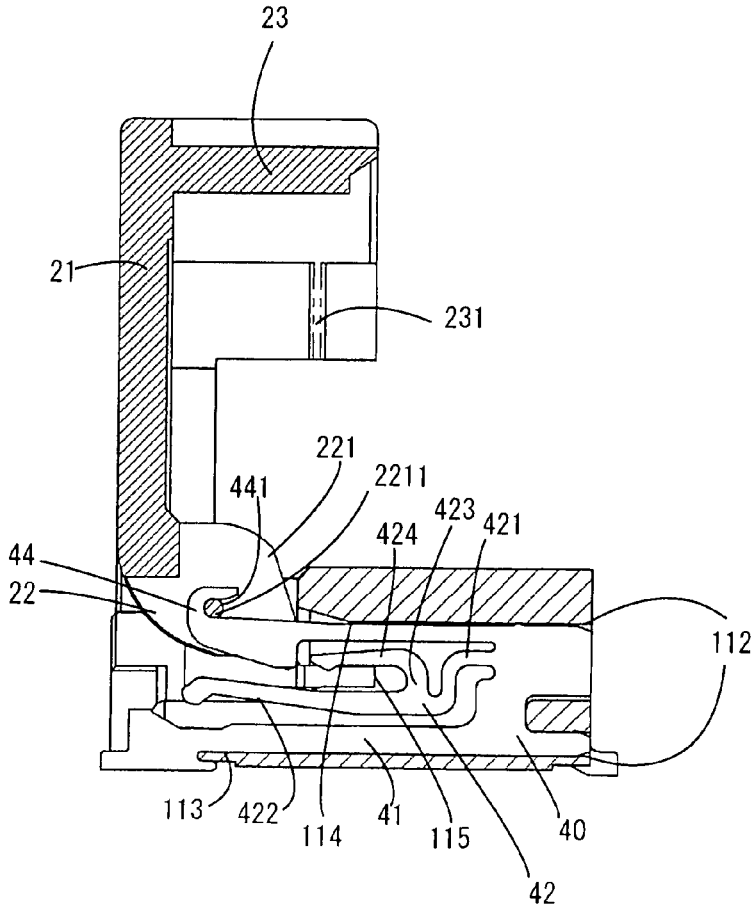

FIG. 1 is a perspective view showing a closed state of a connector for a flexible substrate, FIG. 2 is a perspective view showing an opened state of the same connector, FIG. 3 is an exploded perspective view of the connector, FIG. 4 is cross-sectional views of the connector showing a shape of a contact of the first type thereof, and FIG. 5 is cross-sectional views of the connector showing a contact of the second type thereof connector.

The connector for a flexible substrate cited here is a board mounting type connector that electrically connects a flexible substrate α (refer to FIGS. 4 and 5). At the end of the upper surface of this flexible substrate α, there are arranged in a width direction with electrodes not shown, which match the internal core wires in number and form two rows in a length direction of the board.

More specifically, as shown in FIGS. 1 to 5, the connector for a flexible substrate includes a housing 10 that is a rectangular resin molded element formed with a board insertion port 13 for receiving the flexible substrate α, contacts of a first type 30 and contacts of a first type 40 that are elastic plate-like pieces and contactable with the electrodes of the flexible substrate α inside the housing 10, the first type and second type being provided alternately and in parallel with each other, and an actuator 20 that is an resin molded element having a substantially L-shaped side view, is supported pivotally and rotatably on the upper side of the housing 10 and is provided with cam portions of a first type 2222 and cam portions of a second type 2212 that directly/indirectly press the contacts of the first and second types 30 and 40 for bringing the contacts into pressure contact with the electrodes of the flexible substrate α when the actuator 20 is rotated to be put into the closed state.

The housing 10 has a body 11 having a plurality of chambers formed therein for housing the contacts of the first and second types 30 and 40 alternately and adjacent to each other, and a receiving portion 12 having a substantially L-shaped side view and being provided continuously form the body 11.

In a front surface (the side for inserting the flexible substrate α) of the body 11, openings 114 for receiving the contacts of the second type 40 and openings 113 for exposing end portions of the contacts of the first type 30 are formed alternately and adjacent to each other. On the other hand, in the back surface (the side opposite to the side for inserting the flexible substrate α is inserted) of the body 11, openings 111 for inserting the contacts of the first type 30 and openings 112 for exposing end portions of the contacts of the second type 40 are formed alternately and adjacent to each other.

The contacts of the second type 40 are inserted into the body 11 through the openings 114 of the body 11, and the end portions thereof are exposed from the openings 112 of the body 11. On the other hand, the contacts of the first type 30 are inserted into the body 11 through the openings 111 of the body 11, and the end portions thereof are exposed from the openings 113 of the body 11.

Locking pieces 116 for maintaining the closed state of the actuator 20 are provided on both side surfaces of the body 11. Moreover, on the front side of the body 11, a slit 115 is formed in a position corresponding to the board insertion port 13 to insert the flexible substrate α (refer to FIGS. 4(*b*) and 5(*b*)). By bringing a tip end portion of the flexible substrate a into contact with the backside of the slit 115, the electrodes of the flexible substrate α and the contacts of the first and second types 30 and 40 are aligned.

In an upper surface of the receiving portion 12, grooves 121 are formed at the same pitch intervals as those of the openings 114. The grooves 121 on the receiving portion 12 guide the contacts of the second type 40 to be inserted into the openings 114 of the body 11. A clearance between the receiving portion 12 of the housing 10 and a shaft portion 22 of the actuator 20 serves as the board insertion port 13, and the openings 113 and 114 of the body 11 are located on the back side of the board insertion port 13.

The contacts of the first type 30 are adapted to contact with electrodes in an inner row of the flexible substrate α, and each has a base portion 31 attachable to a back portion of the board insertion port 13 of the housing 10, an arm portion 32 that is a substantially U-shaped body in side view, is supported in midair by the base portion 31 and is adapted to support the end portion of the flexible substrate α, and a contact point portion 33 that is arranged inside the arm portion 32 and is adapted to contact with the electrodes of the flexible substrate α.

The base portion 31 has a substantially U shape in side view and is attachable to the body 11 of the housing 10 through the corresponding one of the openings 111.

The arm portion 32 has an elastic supporting portion 321 extended inward from the base portion 31, a lower linear portion 322 being provided continuously from an end portion of the elastic supporting portion 321 and adapted to receive the end portion of the flexible substrate α from below, a ½ circular arc portion 323 being provided continuously form an end portion of the lower linear portion 322 and has a tip portion folded back in a counter board-insertion-direction, and an upper linear portion 324 provided continuously from an end portion of the ½ circular arc portion 323.

The elastic supporting portion 321 is extended from a position on the lower side and counter board-insertion-direction side of the base portion 31. The tip portion of the elastic supporting portion 321 is bent in the board-insertion-direction to form a ¼ circular arc.

The upper linear portion 324 is longer than the lower linear portion 322. The corresponding cam portion of the first type 2222 of the actuator 20 is contactable with the upper surface of a tip portion of the upper linear portion 324.

The contact point portion 33 is arranged on the underside of the upper linear portion 324 and in a position opposed to the lower linear portion 322. In addition, it is not arranged at the tip portion of the upper linear portion 324, but in a position on the board-insertion-direction side as compared with the corresponding cam portion of the first type 2222 of the actuator 20.

The contacts of the second type 40 are adapted to contact with electrodes in an outer row of the flexible substrate α, and each has a base portion 41 attachable to a back portion of the board insertion port 13 of the housing 10, an arm portion 42 that is a substantially U-shaped body in side view, is supported in midair by the base portion 41, and is adapted to support the end portion of the flexible substrate α, a contact point portion 43 provided inside the arm portion 42 and is adapted to contact with the electrodes of the flexible substrate α, and a rotary shaft holding portion 44 extended outward from the base portion 41.

The base portion 41 has a substantially U shape in side view and is attachable to the body 11 of the housing 10 through the corresponding one of the openings 114.

The arm portion 42 has an elastic supporting portion 421 extended inward from the base portion 41, a lower linear portion 422 being provided continuously from an end portion of the elastic supporting portion 421 and adapted to receive the end portion of the flexible substrate α from below, a ½ circular arc portion 423 being provided continuously from an end portion of the lower linear portion 422 and has a tip portion folded back in the counter board-insertion-direction, and an upper linear portion 424 provided continuously from an end portion of the ½ circular arc portion 423.

The elastic supporting portion 421 is extended from the board-insertion-direction side of the base portion 41. The tip portion of the elastic supporting portion 421 is bent downward to form a ¼ circular arc.

The lower linear portion 422 is longer than the upper linear portion 424, which is different from the case of the contact of the first type 30. The corresponding cam portion of the second type 2212 of the actuator 20 is located above the tip portion of the lower linear portion 422.

The contact point portion 43 is arranged on the underside of the upper linear portion 424 and in a position opposed to the lower linear portion 422. Unlike the contact of the first type 30, the contact point portion 43 is arranged in a tip portion of the upper linear portion 424.

The rotary shaft holding portion 44 is extended from a position on the counter board-insertion-direction side and upper side of the base portion 41 so as to be bent into a ¼ circular arc. In a tip portion of the rotary shaft holding portion 44, there is formed a notched hole 441 for holding a rotary shaft 2211 of the actuator 20.

The actuator 20 has a base plate 21 having a length corresponding to the body 11 of the housing 10, the shaft portion 22 provided continuously from the base end of the base plate 21, and a dustproof cover portion 23 provided continuously from the tip end of the base plate 21.

Lengthwise on the lower side of the shaft portion 22, shaft plates 221 and 222 are provided alternately and adjacent to and in parallel with each other. The shaft plates 221 and 222 are set at the same pitch intervals as those of the contacts of the first and second types 30 and 40. The shaft plates 221 and 222 are fan-like plate bodies and their lower corner portions serve as the cam portions of the second type 2212. The shaft plates 221 are provided in the central portions of one surfaces thereof with the rotary shafts 2211 oriented in the axis direction of the shaft portion. On the other hand, the shaft plates 222 are provided outside the centers of one surfaces thereof with the cam portions of the first type 2222 oriented in the axis direction of the shaft portion.

The dustproof cover portion 23 is a U-shaped plate-like body in top view for hiding the back surface in whole and the opposite side surfaces in part of the body 11 of the housing 10. In inner surfaces of the dustproof cover portion 23, there are provided protruded portions 231 that may run on the locking pieces 116 of the body 11 of the housing 10 for engagement.

Hereinafter, an assembling method and a usage of the connector for a flexible substrate constituted as above are described.

First, in a state where the base plate 21 of the actuator 20 is placed on and aligned with an upper surface of the body 11 of the housing 10, the contacts of the second type 40 are inserted into and attached to the body 11 of the housing 10. At this time, the tip portions of the contacts of the second type 40 are partially exposed from the openings 112 of the body 11 of the housing 10. Moreover, the rotary shaft 2211 of the actuator 20 is put into the notched holes 441 of the rotary shaft holding portions 44 of the contacts of the second type 40.

When all the contacts of the second type 40 are attached inside the body 11 of the housing 10, the rotary shafts 2211 provided in the respective shaft plates 221 of the actuator 20 are pivotally supported by the rotary shaft holding portions 44 of the contacts of the second type 40.

As a result, the actuator 20 becomes rotatable around the rotary shafts 2211 with respect to the housing 10. Since the contacts of the second type 40 are attached and fixed to the housing 10, the actuator 20 does not drop off from the housing 10 easily.

FIGS. 4(*a*) and 5(*a*) show the closed state of the connector for a flexible substrate. In this state, the base plate 21 of the actuator 20 is in contact with the upper surface of the body 11 of the housing 10, and the actuator 20 covers at least the upper surface of the housing 10.

FIGS. 4(*b*) and 5(*b*) show the opened state of the connector for a flexible substrate. In this state, the cam portions of the second type 2212 of the actuator 20 are in contact with the front surface of the body 11 of the housing 10, and the actuator 20 stands perpendicular to the housing 10, thereby exposing at least the upper surface of the housing 10.

In the opened state of the actuator 20, the contacts of the first type 30 are inserted into and attached to the body 11 of the housing 10. At this time, tip portions of the contacts of the first type 30 are exposed from the openings 113 of the body 11 of the housing 10, and in addition, the cam portions of the first type 2222 of the actuator 20 are put into respective clearances between the upper tip portions of the bases 31 of the contacts of the first type 30 and the upper linear portions 324 of the arm portions 32.

In the opened state of the actuator 20, since the cam portions of the first type 2222 are oriented in the horizontal direction, they do not cause any interference in the attachment of the contacts of the first type 30.

The connector for a flexible substrate assembled in the above manner is attached to the end portion of the flexible substrate α as described below.

First, in the state where the actuator 20 is opened, the end portion of the flexible substrate α is inserted into the housing 10 through the board insertion port 13. Consequently, the end portion of the flexible substrate α is inserted into the arm portions 32 and 42 of the contacts of the first and second types 30 and 40, so that the tip end of the flexible substrate makes contact with the back side of the slit 115 of the body 11.

In this state, the electrodes of the flexible substrate α and the contacts of the first and second types 30 and 40 are aligned. That is, the contact point portions 33 of the contacts of the first type 30 are aligned with the electrodes in the inner row of the flexible substrate α, and the contact point portions 43 of the contacts of the second type 40 are aligned with the electrodes in the outer row of the flexible substrate α.

Then, the actuator 20 is rotated to be put into the closed state. Consequently, the closed state is kept. The cam portions of first type 2222 are inclined from the horizontal direction to the vertical direction to make contact with the upper tip portions of the upper linear portions 324 of the contacts of the fist type 30 and press the same, so that the contact point portions 33 of the contacts of the first type 30 come into pressure contact with the electrodes in the inner row of the flexible substrate α. At this time, the end portion of the flexible substrate α is supported by the lower linear portions 322 of the arm portions 32 of the contacts of the first type 30, and the entire arm portions 32 are elastically deformed, which ensures the pressure contact between the flexible substrate and the contacts 30.

Moreover, when the actuator 20 is put into the closed state, the cam portions of the second type 2212 are inclined to make contact with the upper surface of the end portion of the flexible substrate α and press the same. In accordance with this, the upper tip portions of the lower linear portions 422 of the contacts of the second type 40 are pressed through the flexible substrate α. In accordance with this, the entire arm portions 42 are elastically deformed, and the contact point portions 43 of the contacts of the second type 40 come into pressure contact with the electrodes in the outer row of the flexible substrate α even when the end portion of the flexible substrate α is slightly pressed down, because it is supported by the lower linear portions 442 of the arm portions 42 of the contacts of the second type 40, a positional relation between the electrodes of the flexible substrate α and the contact point portions 43 of the contacts of the second type 40 remain stable, and thus ensures the pressure contact between the flexible substrate and the contacts 40.

Additionally, when the actuator 20 is put into the closed state, the end portion of the flexible substrate α is meshingly engaged between the second cam portions 2212 and the receiving portion 12 of the housing 10, so that the flexible substrate α is not easily pulled out of the housing 10.

When the actuator 20 is in the closed state, the back surface of the body 11 of the housing 10 and the like are arranged so as to face the dustproof cover portion 23. In the opened state, the end portions of the contacts of the first and second types 30 and 40 are exposed through the openings 111 and 112 formed on the back side of the body 11 of the housing 10, in the closed state, these exposed portions are covered. The connector with such configuration will become more resistant to the dust, thereby suffer from fewer failures, and consequently improve in performance.

Conversely, when the actuator 20 is rotated in the opposite direction, namely from the closed state into the opened state, the cam portions of the first and second types 2222 and 2212 return to the original positions, and in accordance with this, the contacts of the first and second types 30 and 40 are released from pressure through the cam portions of the first and second types 2222 and 2212. Thus, not only the contact point portions 33 and 43 of the contacts of the first and second types 30 and 40 can go away from the electrodes of the flexible substrate α, but also the flexible substrate α can be easily pulled out of the housing 10.

In the case of the connector for a flexible substrate constituted as described above, when the actuator 20 is put into the closed state, and the cam portions of the first and second types 2222 and 2212 are pressed onto the arm portions 32 and 42 of the contacts of the first and second types 30 and 40, the entire arm portions 32 and 42 are largely deformed elastically, and in accordance with this, a large contact pressure can be obtained between the contact point portions 33 and 43 of the contacts of the first and second types 30 and 40 and the electrodes of the flexible substrate α.

Unlike the conventional example, the present invention can obviate the need for using long contacts or selecting a highly elastic material for the contacts of the first and second types 30 and 40 in order to obtain large contact, and therefore the invention contributes to the downsizing of the entire connector and reduced cost. Moreover, since the rotary shaft holing portions 44 are provided in the contacts of the second type 40, the invention may totally or partly dispense with parts for preventing the pull-out of the actuator and for pivotally supporting the same, which simplifies the construction of the connector resulting in reduced cost.

The connector for a flexible substrate according to the present invention can be of any type, as long as it is adapted to contact with electrodes arranged in parallel on a flexible substrate. For example, in the case where the number of rows of the electrodes is one, one type of contacts may be used, and in the case where there are the electrodes arranged in parallel with each other on the back surface of the flexible substrate, the contact point portions of the contacts may be disposed on the lower sides of the arm portions instead of being arranged on the upper side thereof.

As to the housing, any shape and any material may be employed, as long as it has a board insertion port for receiving the flexible substrate.

As to the contact, the base portion may be of any configuration such as shape as long as it can be attached on the back side of the insertion port of the housing, and the arm portion may be of any configuration such as shape as long as it is a substantially U-shaped body in side view supported in midair by the base portion and supporting the end portion of the flexible substrate. Furthermore, for the contact point portion, any shape or the like may be employed, as long as it is provided on the inner side of the arm portion and may make contact with contacts of the flexible substrate.

As for the actuator, any type of actuator may be used as long as it is constituted so as to be supported pivotally and rotatably on the upper side of the housing, and as long as it is provided with the cam portions that directly or indirectly press the contacts for bringing the contacts into pressure contact with the electrodes of the flexible substrate when the actuator is rotated to be put into the closed state.

What is claimed is:

1. A connector for a flexible substrate comprising:

a housing having a board insertion port for receiving a flexible substrate;

contacts of a first type provided in parallel with each other so as to be contactable with electrodes of the flexible substrate inside of the housing; and an actuator supported pivotally and rotatably on an upper side of the housing;

each of the contacts of the first type having:

a base portion being substantially U-shaped in side view and attachable to a back portion of the board insertion port of the housing;

an arm portion having a substantially U-shaped side view, being supported in midair by the base portion and being adapted to support an end portion of the flexible substrate; and a contact point portion being arranged inside the arm portion, extended downward, and adapted to contact with the electrodes of the flexible substrate;

wherein the arm portion of the each contact of the first type has:

an elastic supporting portion extended horizontally inward from a position on a lower side and counter board-insertion-direction side of the base portion, a tip portion of the elastic supporting portion being bent in a board-insertion-direction to form a ¼ circular arc;

a lower linear portion being provided continuously from an end portion of the elastic supporting portion and adapted to receive the end portion of the flexible substrate from below;

a ½ circular arc portion being provided continuously from an end portion of the lower linear portion and having a tip portion folded back in the counter board-insertion-direction; and an upper linear portion being provided continuously from an end portion of the ½ circular arc portion, wherein the actuator is provided with cam portions of the first type, each cam portion of the first type being contactable with an upper surface of a tip portion of the upper linear portion of the arm portion of each of the contacts of the first type, for bringing the contacts of the first type into pressure contact with the electrodes of the flexible substrate when the actuator is put into a closed state, and wherein the contact point portion of the each contact of the first type is arranged in a position on the board-insertion-direction side as compared with the corresponding one of the cam portions of the first type.

2. The connector according to claim 1, wherein the contact point portion of the each contact of the first type is arranged on the underside of the upper linear portion of the arm portion and in a opposed position to the lower linear portion.

3. The connector according to claim 1, further comprising contacts of a second type, arranged alternately and in parallel with the contacts of the first type, wherein each of the contacts of the second type includes:

a base portion being substantially U-shaped in side view and attachable to a back portion of the board insertion port of the housing;

an arm portion having a substantially U-shaped side view, being supported in midair by the base portion and being adapted to support the end portion of the flexible substrate; and a contact point portion being arranged inside the arm portion, exended downward, and adapted to contact with the electrodes of the flexible substrate, wherein the arm portion of the each contact of the second type has:

an elastic supporting portion extended from a position on the board-insertion-direction side of the base portion to the counter board-insertion-direction side, a tip portion of the elastic supporting portion being bent downward to form a ¼ circular arc;

a lower linear portion being provided continuously from an end portion of the elastic supporting portion and adapted to receive the end portion of the flexible substrate from below;

a ½ circular arc portion being provided continuously from an end portion of the lower linear portion and having a tip portion folded back in a counter board-insertion-direction; and an upper linear portion being provided continuously from an end portion of the ½ circular arc portion.

4. The connector according to claim 3, wherein the arm portion of the each contact of the second type has the lower linear portion longer than the upper linear portion, and the actuator further comprises cam portions of the second type, each cam portion of the second type being contactable with a position on the flexible substrate near a tip portion of the lower linear portion of the arm portion of the corresponding one of the contacts of the second type when the actuator is put into the closed state.

5. The connector according to claim 3, wherein the each contact of the second type has a rotary shaft holding portion, the rotary shaft holding portion extending outward from a position on an upper side and counter board-insertion-direction side of the base portion and having a notched hole for holding a rotary shaft of the actuator.

6. The connector according to claim 3, wherein the contact point portion of the each contact of the second type is arranged on the underside of the upper linear portion of the arm portion and in an opposed position to the lower linear portion.

7. The connector according to claim 1, in the case where board-insertion-direction-side end portions of the contacts of the first type are exposed from a surface on the opposite side of the board insertion port of the housing, wherein the actuator is provided with a dustproof cover portion on a tip end portion thereof, the dustproofcover portion being arranged so as to face said surface of the housing in the closed state.

* * * * *